US009399238B1

(12) United States Patent
Mao et al.

(10) Patent No.: US 9,399,238 B1
(45) Date of Patent: Jul. 26, 2016

(54) TELESCOPIC WATER GUN

(71) Applicants: Tsuo-Fei Mao, Changhua (TW); Yu-Heng Su, Changhua (TW); Ciao-Wun Chen, Changhua (TW); Chen-Fu Hung, Changhua (TW)

(72) Inventors: Tsuo-Fei Mao, Changhua (TW); Yu-Heng Su, Changhua (TW); Ciao-Wun Chen, Changhua (TW); Chen-Fu Hung, Changhua (TW)

(73) Assignee: Ruey Ryh Enterprise Co. Ltd., Changhua (TW)

( * ) Notice: Subject to any disclaimer, the term of this patent is extended or adjusted under 35 U.S.C. 154(b) by 0 days.

(21) Appl. No.: 14/597,664

(22) Filed: Jan. 15, 2015

(51) Int. Cl.
*B05B 15/06* (2006.01)
*B05B 9/01* (2006.01)

(52) U.S. Cl.
CPC ..... *B05B 15/064* (2013.01); *B05B 9/01* (2013.01)

(58) Field of Classification Search
USPC ..... 239/532
See application file for complete search history.

(56) References Cited

U.S. PATENT DOCUMENTS 5,584,594 A * 12/1996 Newville ..... A46B 11/063 239/532
6,609,847 B1 * 8/2003 Wang ..... A46B 11/06 15/144.4
6,619,570 B1 * 9/2003 Ericksen ..... B05B 15/068 239/532
6,719,331 B1 * 4/2004 Chen ..... F16B 7/1463 239/532
2010/0320288 A1 * 12/2010 Lo ..... A01G 25/14 239/165

* cited by examiner

*Primary Examiner* — Len Tran
*Assistant Examiner* — Adam J Rogers
(74) *Attorney, Agent, or Firm* — Che-Yang Chang; Law Offices of Scott Warmuth

(57) ABSTRACT

A telescopic water gun includes an inner tube, with an end coupled with a water outlet gun and another end sleeved with an outer tube, which has a deformable restraint ring and blocking sleeve disposed at the sleeving end, an upper end of the blocking sleeve being disposed with an outer thread section screwed with a pressing sleeve for tightly sleeving on the outer thread section; a water inlet connector sleeved at another end of the outer tube disposed with a water receiving end and a smaller diameter sleeving end, a large diameter water stopping section and small diameter water stopping section therebetween; and a water inlet controlling sleeve sleeving around the water controlling section with its inner diameter, a large diameter opening formed at a lower end of the water inlet controlling sleeve for sleeving around the a large diameter water stopping section of the water inlet connector.

5 Claims, 8 Drawing Sheets

TELESCOPIC WATER GUN

BACKGROUND OF THE INVENTION

1. Field of Invention

The present invention relates to a telescopic water gun and more particularly to a low-cost and simply-designed telescopic water gun with an inner tube and an outer tube which can be retractably operated for speedily positioning, and a water inlet connector disposed at another end of the outer tube which can be used for opening or closing water outlet.

2. Related Art

As illustrated in the structures in FIGS. 1-5 of the utility model patent "Retractable Tube Connector Structure" published in Jun. 1, 2014 with publication number M479372 and filing number 102222745, the retractable water tube can only be connected with an external water source and cannot control the outlet of water.

As stated in the structures mentioned in the abstract of the utility model patent "Improved Positioning Structure of "Retractable Squirt Tube" published in Jun. 1, 2007 with publication number M313198 and filing number 95222047: an inner tube being disposed inside an outer tube, a limiting plug being fixedly disposed at an inserting end of the inner tube, an upper limiting ring sleeve and a lower limiting ring sleeve being fixedly disposed at two ends of the outer tube respectively, the upper limiting ring sleeve being used for the inner tube to go through and for limiting the limiting plug at the end of the inner tube, the upper limiting ring sleeve and the lower limiting ring sleeve being used for preventing the inner tube from detaching from the outer tube, the upper and lower limiting ring sleeves having a sleeving space inside, the sleeving space having an inner circumferential wall protruded from a bottom edge and apart from an outer circumferential wall so that an inserting trough being formed between the inner circumferential wall and the outer circumferential wall for fitting the outer tube, the inner and outer circumferential walls being disposed inside and outside the tubes. Based on the above structures, the limiting ring sleeves disposed at the ends of the outer tube can prevent gap from forming both in dry and wet conditions for keeping secure combinations between the structural members.

As shown in FIGS. 1, 2, 3, 4 and 6, a lower limiting ring sleeve 50 disposed at a lower end of an outer tube 10 does not provide the structure and function that can control the outlet of water, it can only connect the retractable water tube with an external water source. It has to couple with an additional water control structure as shown in FIG. 7 in order to control the water outlet. Thus, the structure is more complicated and it is inconvenient in usage. Furthermore, the complicated structure may increase the manufacturing costs. Therefore, there remains a need for a new and improved telescopic water gun to overcome the problems stated above.

SUMMARY OF THE INVENTION

The present invention of a telescopic water gun aims to solve the above drawbacks of the conventional retractable water tube structure; namely, the connector disposed at the lower end of the outer tube cannot control the water outlet, and need to be coupled with another water control structure; making the structure more complicated, inconvenience in usage and the increase of costs.

A primary objective of the present invention is to provide a telescopic water gun with an inner tube and an outer tube which can be retractably operated for speedily positioning, and a water inlet connector disposed at one end of the outer tube which can be used for opening or closing water outlet.

A secondary objective of the present invention is to provide a telescopic water gun with a simple structure for achieving the function of opening and closing water outlet, and thus the manufacturing costs can be reduced.

A telescopic water gun in the present invention may include:

an inner tube, with one end coupled with a water outlet gun for forming a water outlet end, the other end sleeved inside an outer tube;

the outer tube having a deformable restraint ring disposed at the end sleeving with the inner tube, a blocking sleeve being sleeved below the deformable restraint ring, an upper end of the blocking sleeve being disposed with an outer thread section screwed with a pressing sleeve for tightly sleeving on the outer thread section and for tightly and fixedly screwing and pressing the deformable restraint ring around the inner tube, a water inlet connector and a water inlet controlling sleeve being sleeved at another end of the outer tube;

the water inlet connector being a sleeving structure and disposed with a water receiving end with a larger hole diameter and a smaller diameter sleeving end corresponding to the outer tube, a large diameter water stopping section and a small diameter water stopping section disposed therebetween, and a water controlling section between the large diameter water stopping section and the small diameter water stopping section, two water inlet holes and two water outlet holes disposed at a middle section arranged at higher and lower levels respectively being disposed on an outer wall of the water controlling section; and the water inlet controlling sleeve sleeving around the water controlling section with its inner diameter, a large diameter opening being formed at a lower end of the water inlet controlling sleeve for sleeving around the large diameter water stopping section, a water controlling and guiding trough corresponding to the water inlet hole and the water outlet hole being concavely and longitudinally disposed in the inner diameter, the water inlet controlling sleeve being turned for aligning the water controlling and guiding trough, the water inlet hole and the water outlet hole offsetly and correspondingly and for opening or closing water outlet.

In one embodiment, the deformable restraint ring has an outer circular conical surface and is dissectionally disposed with at least one deformable indentation. An inner wall of the pressing sleeve is disposed with an inner circular conical surface corresponding to the outer circular conical surface. The deformable restraint ring can be tightly fixed around the inner tube by screwing the pressing sleeve around the outer thread section.

In another embodiment, two switching block portions adjacent to the large diameter water stopping section are protrudingly disposed on an outer wall of the water controlling section of the water inlet connector. A switching arced trough corresponding to the switching block portion is concavely disposed on an inner diameter of the water inlet controlling sleeve by a side below each of the two water controlling and guiding troughs. A length between two ends of the switching arced troughs of the water inlet controlling sleeve and the switching block portions form a distance turning combination for positioning and blocking. Thereby, the water controlling and guiding troughs, the water inlet holes and the water outlet holes can be aligned offsetly and correspondingly for opening or closing water outlet.

In still another embodiment, a pressing protruded edge is proturdingly disposed on a lower section of the inner tube. An expanded outer blocking edge is disposed on an inner wall at an end of the outer tube sleeving with the inner tube, and a rolling protruded edge is convexly disposed below the outer blocking edge on the inner wall of the outer tube for blocking and limiting the pressing protruded edge of the inner tube. Thereby, the inner tube can be retractably and limitedly operated.

In a further embodiment, the large diameter water stopping section and the small diameter water stopping section of the water inlet connector have a concavely disposed circular trough sleeved with a water stopping ring respectively.

In still a further embodiment, an outer circumference of each of the two water outlet holes of the water inlet connector has a concavely disposed circular trough sleeved with a circular water stopping piece.

The present invention will become more fully understood by reference to the following detailed description thereof when read in conjunction with the attached drawings.

DETAILED DESCRIPTION OF THE INVENTION

Figure 1:
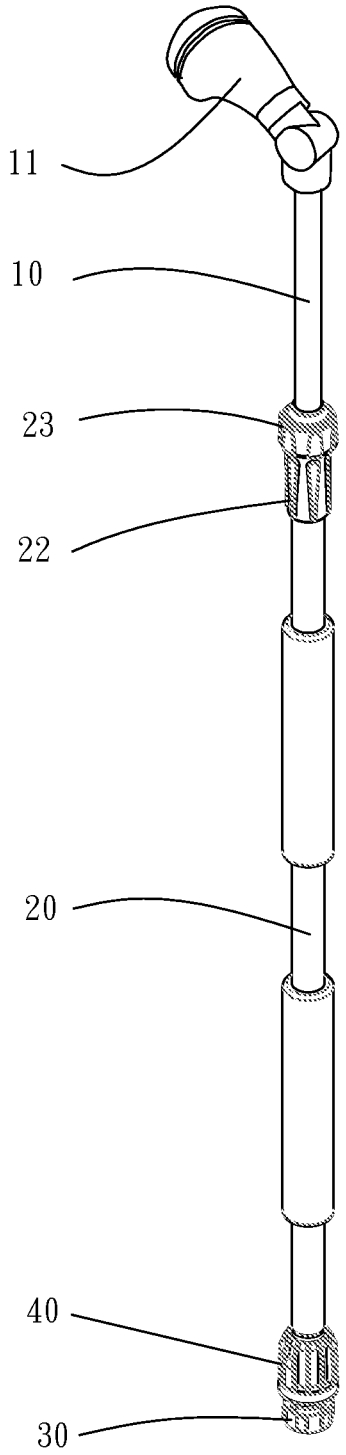
FIG. 1 is a perspective view of a telescopic water gun of the present invention.
Figure 2:
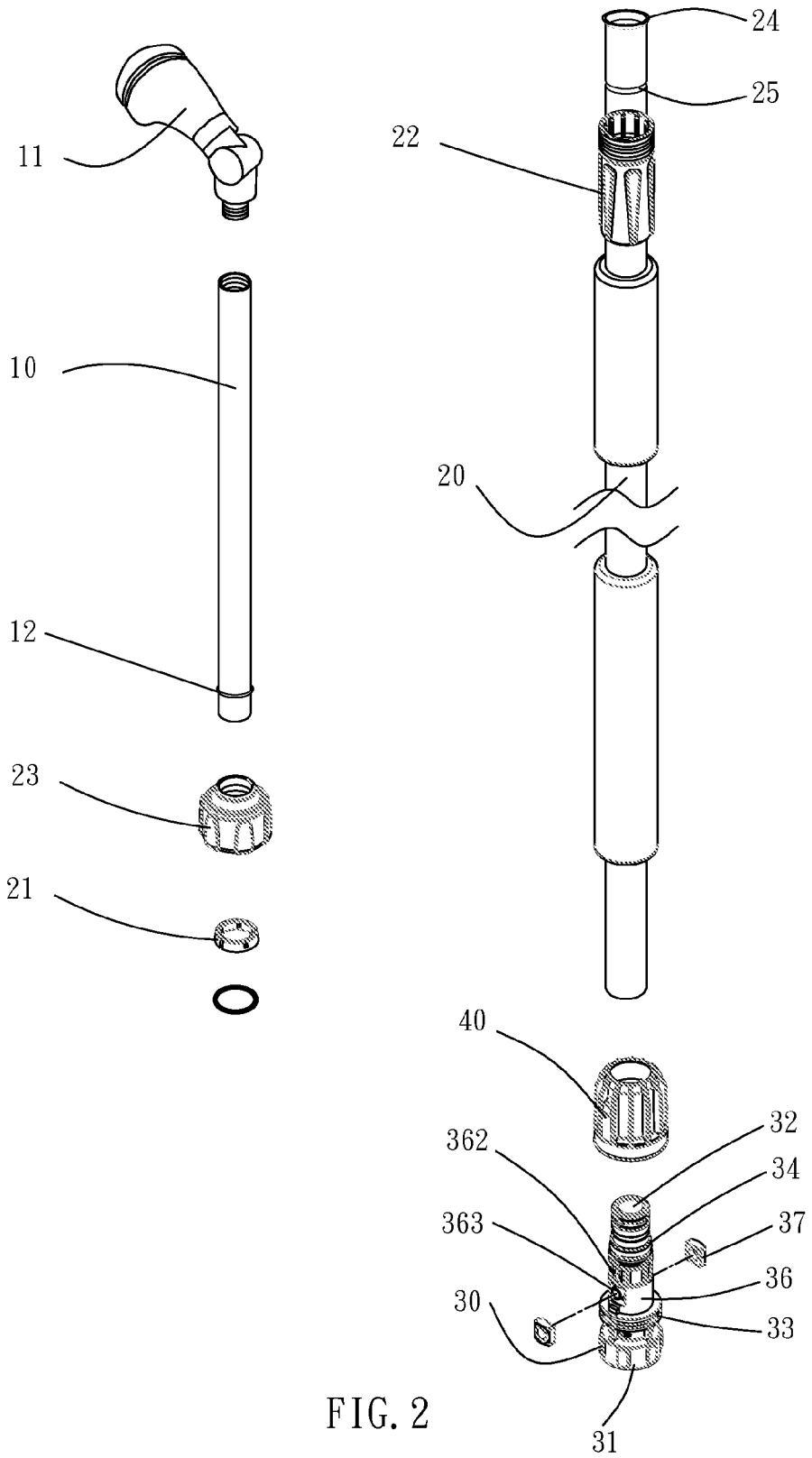
FIG. 2 is a perspective explosive view of the telescopic water gun of the present invention.
Figure 3:
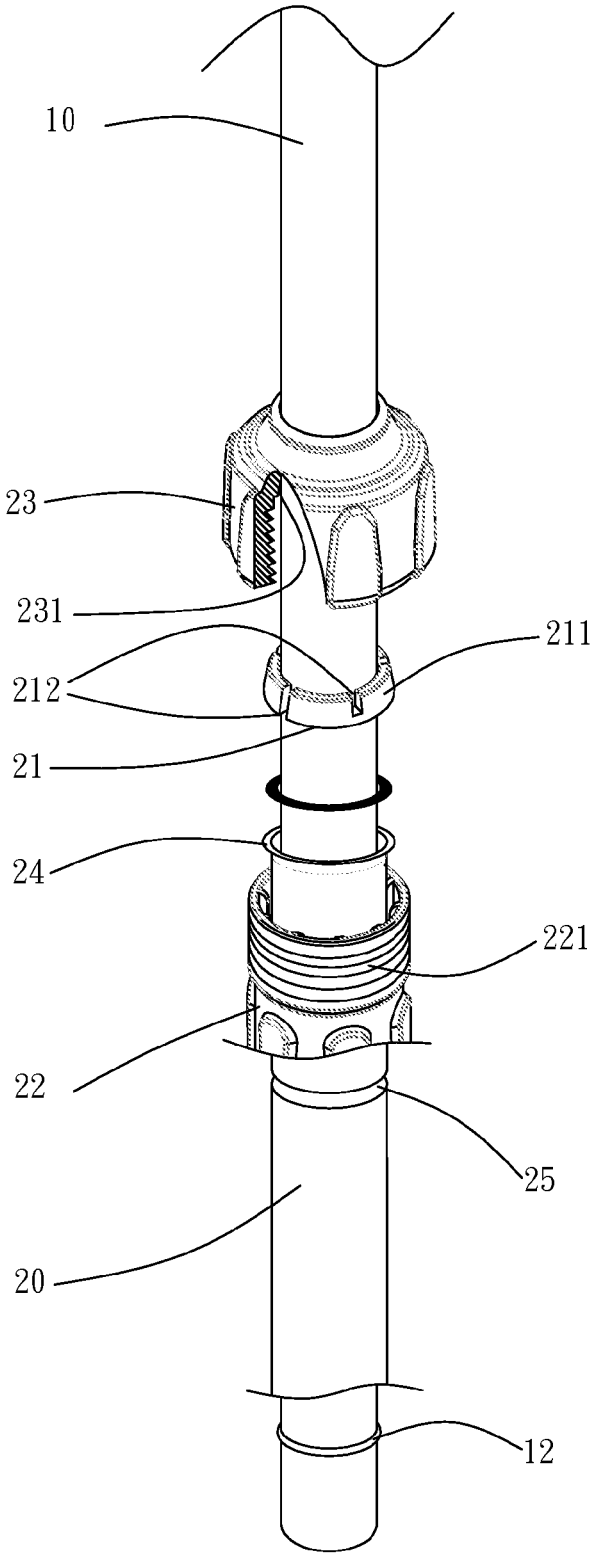
FIG. 3 is a perspective view of a restraint and positioning structure of an inner tube and an outer tube of the telescopic water gun of the present invention.
Figure 4:
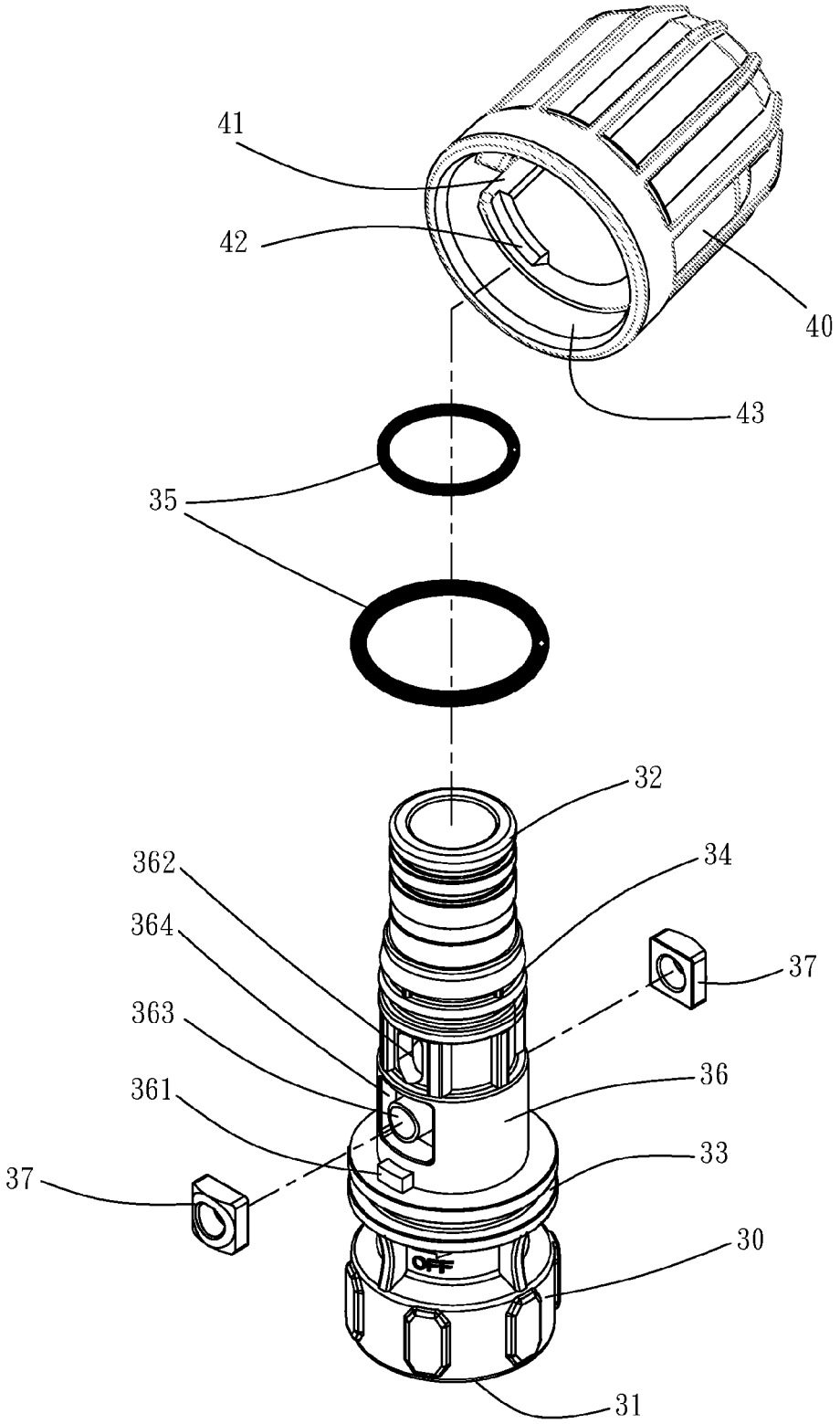
FIG. 4 is a perspective explosive view of a water inlet connector and a water outlet controlling structure at a lower end of the outer tube of the telescopic water gun of the present invention.

FIG. 1 is a perspective view of a telescopic water gun of the present invention; FIG. 2 is a perspective explosive view of the telescopic water gun of the present invention; FIG. 3 is a perspective view of a restraint and positioning structure of an inner tube and an outer tube of the telescopic water gun of the present invention; and FIG. 4 is a perspective explosive view of a water inlet connector and a water outlet controlling structure at a lower end of the outer tube of the telescopic water gun of the present invention. The telescopic water gun of the present invention may include an inner tube 10, an outer tube 20, a water inlet connector 30 and a water inlet controlling sleeve 40.

The inner tube 10 with an end coupled with a water outlet gun 11 for forming a water outlet end, and another end sleeved inside the outer tube 20. A pressing protruded edge 12 is protrudingly disposed on a lower section of the inner tube 10.

Referring to FIG. 3, the outer tube 20 has a deformable restraint ring 21 with an outer circular conical surface 211 disposed at an end sleeving with the inner tube 10, and a blocking sleeve 22 is sleeved below the deformable restraint ring 21. The deformable restraint ring 21 is dissectionally disposed with at least one deformable indentation 212. An upper end of the blocking sleeve 22 is disposed with an outer thread section 221 screwed with a pressing sleeve 23. An inner surface of the pressing sleeve 23 is disposed with an inner circular conical surface 231 corresponding to the outer circular conical surface 211. An expanded outer blocking edge 24 is formed on an inner wall at an end of the outer tube 20 sleeving with the inner tube 10. A rolling protruded edge 25 is convexly disposed below the outer blocking edge 24 on the inner wall of the outer tube 20 for blocking and limiting the pressing protruded edge 12 of the inner tube 10. The water inlet connector 30 and the water inlet controlling sleeve 40 are sleeved at another end of the outer tube 20.

Figure 6:
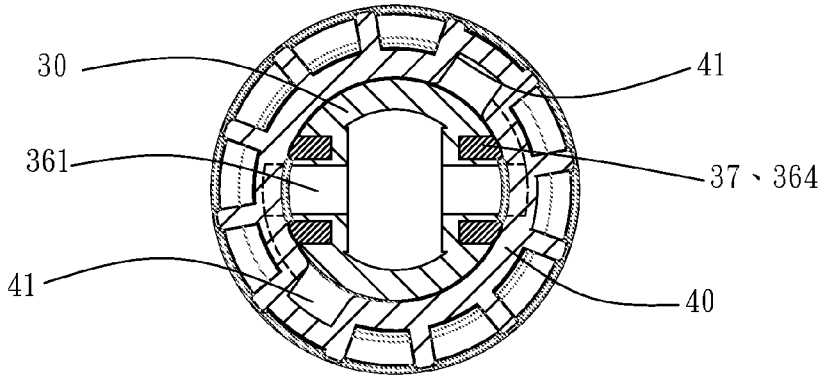
FIG. 6 is a cross sectional view of the water inlet connector and the water outlet controlling structure along line A-A of the telescopic water gun of the present invention.
Figure 5:
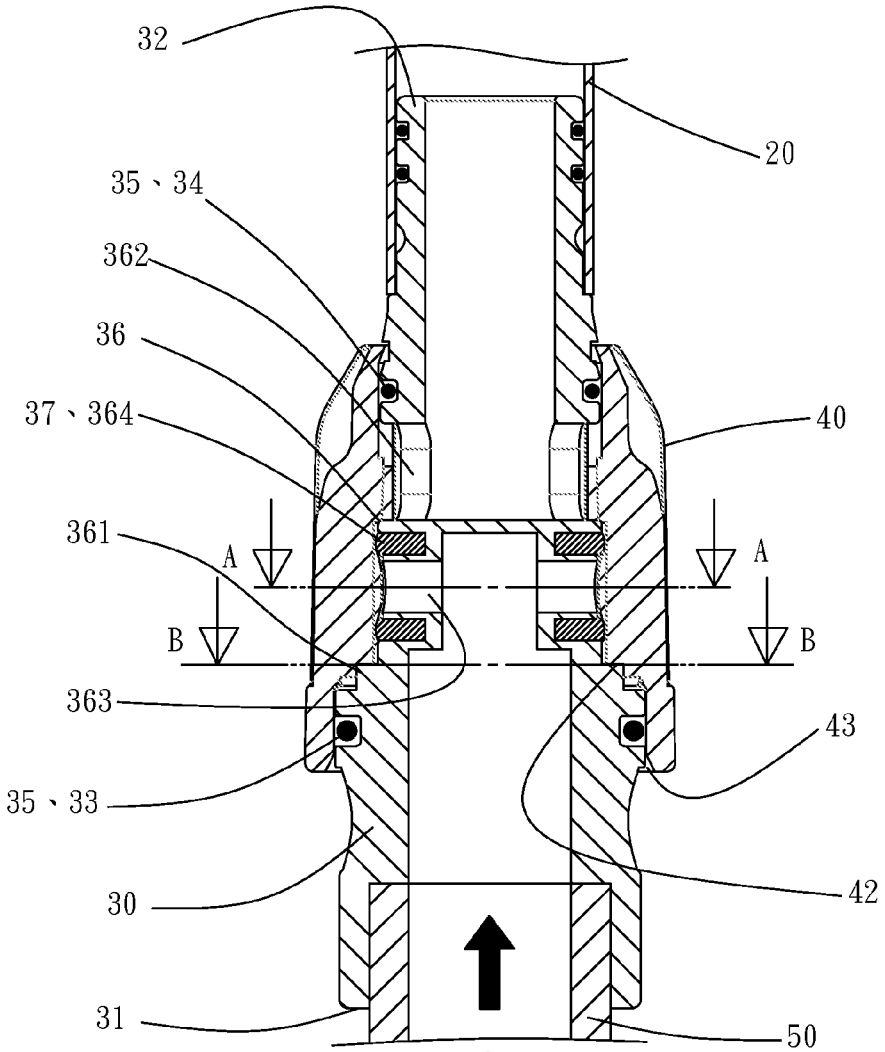
FIG. 5 is a longitudinal sectional view of the water inlet connector and the water outlet controlling structure of the telescopic water gun of the present invention.

Referring to FIGS. 4, 5 and 6, the water inlet connector 30 is a sleeving structure and disposed with a water receiving end 31 with a larger hole diameter and a smaller diameter sleeving end 32 corresponding to the outer tube 20; a large diameter water stopping section 33 and a small diameter water stopping section 34 disposed therebetween, each of the large diameter water stopping section 33 and the small diameter water stopping section 34 having a concavely disposed circular trough sleeved with a water stopping ring 35 respectively; and a water controlling section 36 between the large diameter water stopping section 33 and the small diameter water stopping section 34. Two switching block portions 361 adjacent to the large diameter water stopping section 33 are protrudingly disposed on an outer wall of the water controlling section 36. Two water inlet holes 362 adjacent to the small diameter water stopping section 34 and two water outlet holes 363 at a middle section arranged at higher and lower levels respectively are disposed on the outer wall of the water controlling section 36. An outer circumference of each of the two water outlet holes 363 has a concavely disposed circular trough 364 sleeved with a circular water stopping piece 37.

Referring to FIGS. 4, 5 and 6, the water inlet controlling sleeve 40 is a sleeve structure sleeving around the water controlling section 36 with its inner diameter. A large diameter opening 43 is formed at a lower end of the water inlet controlling sleeve 40 for sleeving around the large diameter water stopping section 33. A water controlling and guiding trough 41 corresponding to the water inlet hole 362 and the water outlet hole 363 is concavely and longitudinally disposed in the inner diameter. A switching arced trough 42 corresponding to the switching block portion 361 is concavely disposed on an inner diameter of the water inlet controlling sleeve 40 by a side below each of the two water controlling and guiding troughs 41.

Figure 8:
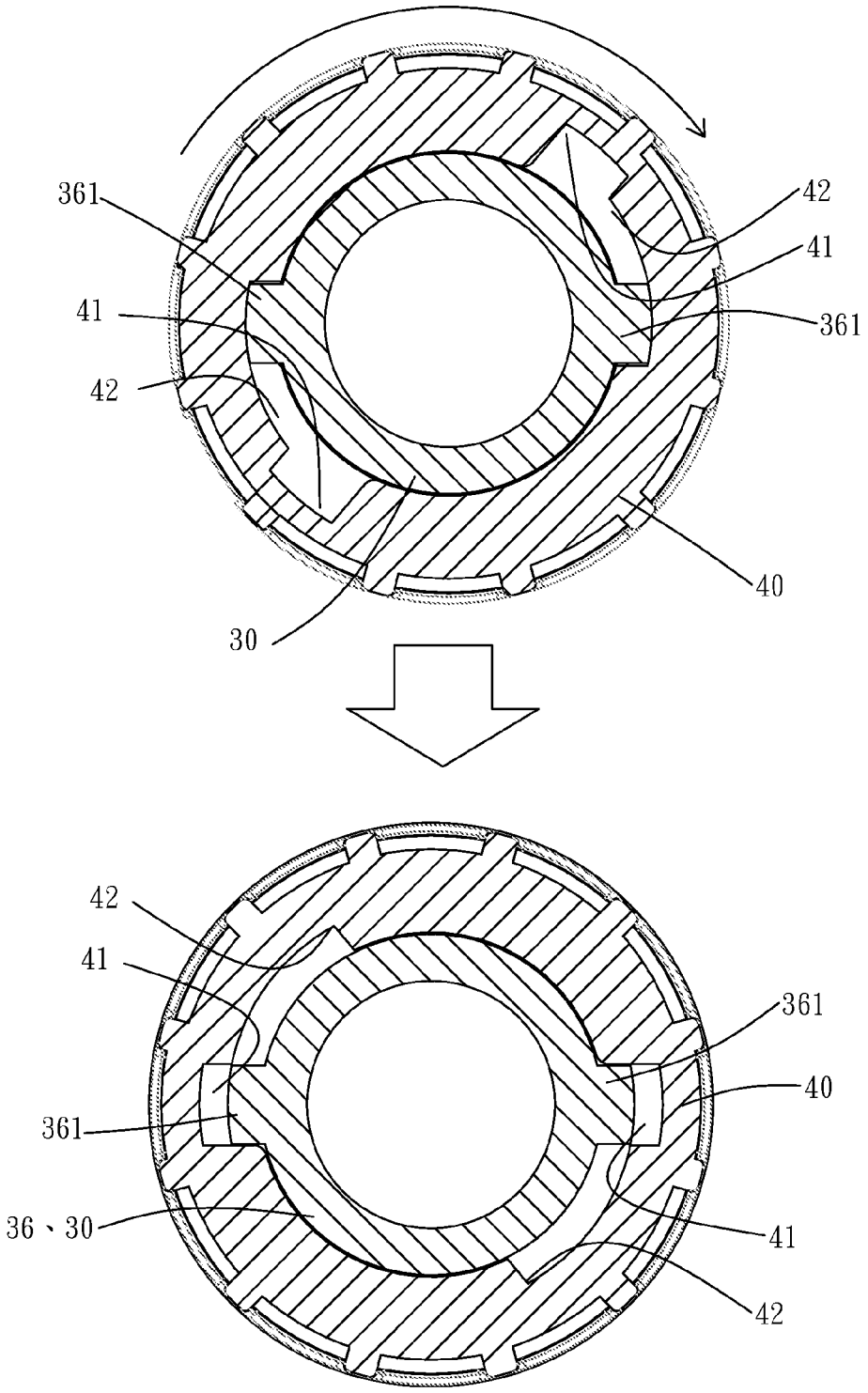
FIG. 8 is a cross sectional view along line B-B of the water inlet connector sleeved with a water inlet controlling sleeve being turned for controlling outlet of water.

Referring to FIGS. 5 and 6, FIG. 5 is a longitudinal sectional view of the water inlet connector and the water outlet controlling structure of the telescopic water gun of the present invention; and FIG. 6 is a cross sectional view of the water inlet connector and the water outlet controlling structure along line A-A of the telescopic water gun of the present invention. The water receiving end 31 of the water inlet connector 30 coupled at the lower end of the outer tube 20 is coupled with a water tube 50 for supplying an external water source. The large diameter water stopping section 33 and the small diameter water stopping section 34 of the water inlet connector 30 sleeved with the water stopping rings 35 are coupled with the large diameter opening 43 at the lower end and an upper opening of the water inlet controlling sleeve 40 for forming an assembly with two ends for stopping water. As shown in FIG. 8, a length between two ends of the switching arced troughs 42 of the water inlet controlling sleeve 40 and the switching block portions 361 form a distance turning combination for positioning and blocking and for controlling outlet of water. Thus, the simply-designed telescopic water gun of the present invention can achieve the opening or closing of water outlet. The structural assembling is simplified effectively and the costs are reduced.

The distance turning is achieved by the switching arced troughs 42 of the water inlet controlling sleeve 40 corresponding with the water controlling and guiding troughs 41. When the water controlling and guiding troughs 41, the water inlet holes 362 and the water outlet holes 363 are turned offsetly, the inner diameter of the water inlet controlling sleeve 40 is pressed against the water stopping pieces 37 around the water outlet holes 363. Thereby, outlet of water is closed.

Figure 7:
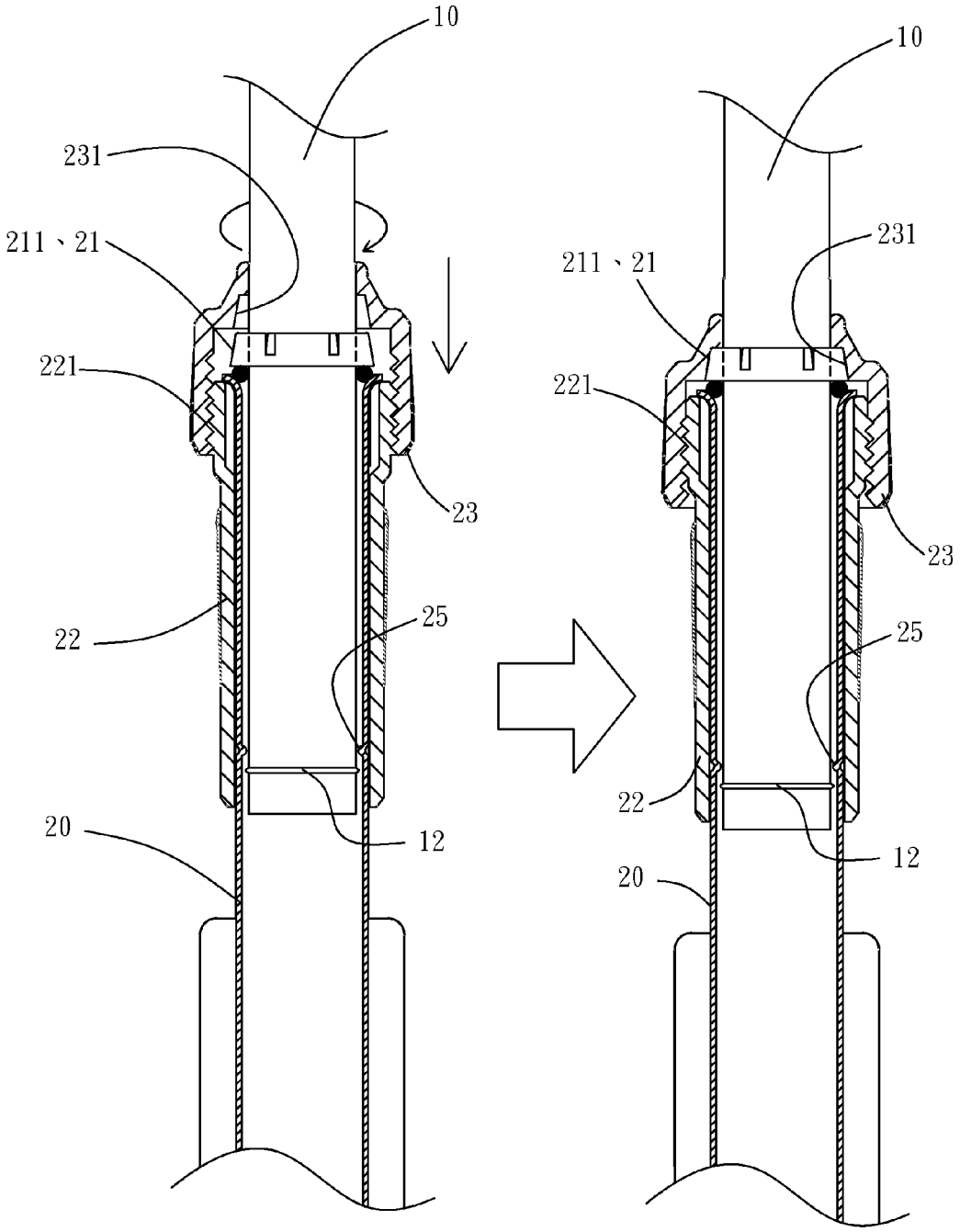
FIG. 7 is an operational view of the inner tube and the outer tube performing restraining and positioning.

FIG. 7 is an operational view of the inner tube and the outer tube performing restraining and positioning. As indicated by the arrow on the left figure, when the pressing sleeve 23 of the outer tube 20 disposed at the sleeving end of the inner tube 10 descends through screwing with the outer thread section 221 at the upper end of the stopping sleeve 22; as indicated in the right figure, the inner circular conical surface 231 on the inner wall presses against the outer circular conical surface 211 of the deformable restraint ring 21, the outer circular conical surface 211 is deformed and reduced in size for restraining the inner tube 10. Thereby, the inner tube 10 can be retractably positioned. The rolling protruded edge 25 disposed at the upper section of the outer tube 20 is provided for blocking and limiting the pressing protruded edge 12 of the inner tube 10. Thereby, the inner tube 10 can be retractably and limitedly operated.

FIG. 8 is a cross sectional view along line B-B of the water inlet connector sleeved with a water inlet controlling sleeve being turned for controlling outlet of water. As illustrated in the upper figure, when the ends of the switching arced troughs 42 (corresponding to the ends of the water controlling and guiding troughs 41) of the water inlet controlling sleeve 40 are turned to press against the switching block portions 361 of the water inlet connector 30; outlet of water is closed as illustrated in FIGS. 5 and 6. When the water inlet controlling sleeve 40 is turned in a direction indicated by the arrow in the upper figure, the water controlling and guiding troughs 41 adjacent to the switching arced troughs 42 correspond with the switching block portions 361 of the water inlet connector 30 as illustrated in the lower figure, water outlet is opened as illustrated in FIGS. 9 and 10.

Figure 10:
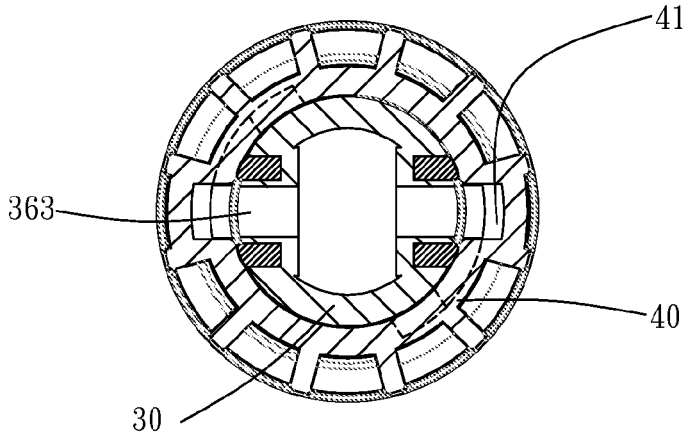
FIG. 10 is a cross sectional view along line A-A of the water inlet connector performing water outlet control.
Figure 9:
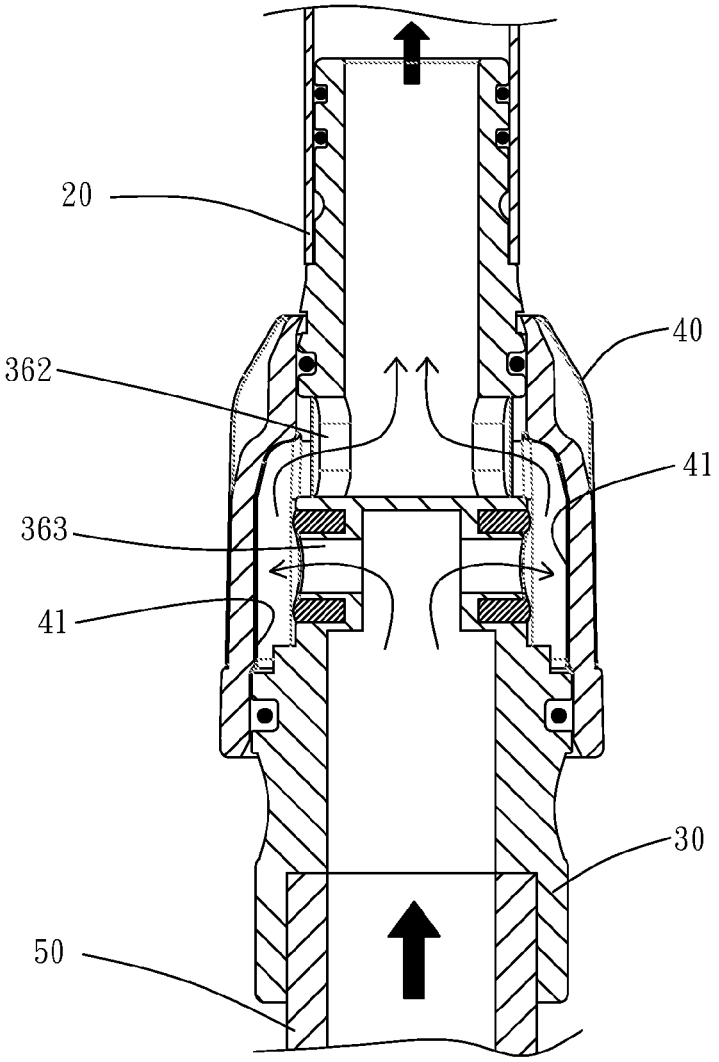
FIG. 9 is a longitudinal sectional view of the water inlet connector performing water outlet control.

FIG. 9 is a longitudinal sectional view of the water inlet connector performing water outlet control; and FIG. 10 is a cross sectional view along line A-A of the water inlet connector performing water outlet control. When outlet of water is required and the water controlling and guiding troughs 41 of the water inlet controlling sleeve 40 are turned to correspond with the water inlet holes 362 and the water outlet holes 363 of the water inlet connector 30; as indicated by the arrows, the external water source connected to the water tube 50 can flow through the water outlet holes 363, the water controlling and guiding troughs 41, then through the water inlet holes 362 to enter into the outer tube 20 coupled with the water inlet connector 30. Finally, as indicated by the solid arrow, the water flows toward the water outlet gun 11 coupled at the other end as shown in FIGS. 1 and 2. Thereby, outlet of water is provided for the user.

The telescopic water gun of the present invention is featured with the inner tube and the outer tube which can be retractably operated for speedily positioning, and the water inlet connector disposed at the other end of the outer tube can be used for opening or closing water outlet. The opening and closing of water outlet can be achieved by the simplified structures. Thus, the structural assembling can be simplified effectively for reducing the costs and it is economically efficient.

Note that the specifications relating to the above embodiments should be construed as exemplary rather than as limitative of the present invention, with many variations and modifications being readily attainable by a person of average skill in the art without departing from the spirit or scope thereof as defined by the appended claims and their legal equivalents.

What is claimed is:

1. A telescopic water gun comprising:

an inner tube;

an outer tube coupled to the inner tube;

a water inlet connector being a sleeving structure and sleeving with the outer tube, the water inlet connector being disposed with a water receiving end with a larger hole diameter and a smaller diameter sleeving end corresponding to the outer tube, the water inlet connector having a large diameter water stopping section, a small diameter water stopping section and a water controlling section disposed between the large diameter water stopping section and the small diameter water stopping section, wherein at least one water inlet hole and at least one water outlet hole are disposed on a circumferential side wall of the water controlling section and are aligned in a line substantially parallel to an axial direction of the water inlet connector, and at least one switching block portion is disposed on the water controlling section at a position near the large diameter water stopping section; and a water inlet controlling sleeve sleeving around the water controlling section with its inner diameter, a large diameter opening being formed at a lower end of the water inlet controlling sleeve for sleeving around the large diameter water stopping section, wherein a water controlling and guiding trough corresponding to the water inlet hole and the water outlet hole and a switching arced trough for receiving the switching block portion are both disposed on the water inlet controlling sleeve, and the water controlling and guiding trough is connected with the switching arced trough.

2. The telescopic water gun as claimed in claim 1, wherein the outer tube has a deformable restraint ring tightly fixed around the inner tube.

3. The telescopic water gun as claimed in claim 1, wherein the water controlling and guiding trough is substantially perpendicular to the switching arced trough.

4. The telescopic water gun as claimed in claim 1, wherein the large diameter water stopping section and the small diameter water stopping section of the water inlet connector have a concavely disposed circular trough sleeved with a water stopping ring respectively.

5. The telescopic water gun as claimed in claim 1, wherein an outer circumference of each of the two water outlet holes of the water inlet connector has a concavely disposed circular trough sleeved with a circular water stopping piece.

* * * * *